US006082658A

United States Patent [19]

Weeger et al.

[11] Patent Number: 6,082,658

[45] Date of Patent: Jul. 4, 2000

[54] METHOD OF AND APPARATUS FOR WINDING ROVING BOBBINS

[75] Inventors: Hans-Peter Weeger, Hattenhofen; Franz Machnik, Göppingen, both of Germany

[73] Assignee: Zinser Textilmaschinen GmbH, Ebersbach/Fils, Germany

[21] Appl. No.: 09/216,583

[22] Filed: Dec. 18, 1998

[30] Foreign Application Priority Data

Dec. 22, 1997 [EP] European Pat. Off. ..... 97122677

[51] Int. Cl.[7] ..... B65H 54/00; D01H 9/14

[52] U.S. Cl. ..... 242/475.7; 57/267; 57/278; 57/299; 242/472.1

[58] Field of Search ..... 242/475.7, 472.1; 57/264, 267, 269, 278, 299

[56] References Cited

U.S. PATENT DOCUMENTS

| | | | |
|---|---|---|---|
| 4,196,575 | 4/1980 | Novak | 57/267 |
| 5,117,621 | 6/1992 | Feichtinger et al. | 57/278 |
| 5,331,799 | 7/1994 | Weeger | 57/287 |
| 5,341,633 | 8/1994 | Nishikawa et al. | 57/264 |
| 5,400,582 | 3/1995 | Hartmeier et al. | 57/264 |
| 5,524,428 | 6/1996 | Locatelli et al. | 57/278 X |
| 5,575,141 | 11/1996 | Genevray | 242/475.7 X |

FOREIGN PATENT DOCUMENTS

| | | |
|---|---|---|
| 0 386 519 | 9/1990 | European Pat. Off. . |
| 0 518 823 | 12/1992 | European Pat. Off. . |
| 0 698 678 | 2/1996 | European Pat. Off. . |
| 0 409 755 | 1/1991 | Germany . |
| 690 05 384 | 7/1994 | Germany . |

*Primary Examiner*—Michael R. Mansen
*Attorney, Agent, or Firm*—Herbert Dubno

[57] ABSTRACT

The roving slubbing at the conclusion of winding of a roving bobbin in a flyer type machine is passed in a descending spiral around the cylindrical body bobbin and then onto the lower winding cone, after it is looped in an overwinding onto the winding tube below the lower winding cone. The winding then passes in a spiral upwardly and is formed into a short spiral segment which is drawn out by a traction on the roving so that the latter will break along the cylindrical body. The bobbin is stable and can easily be handled and transported directly and there is a reduced possibility for the slubbing to come loose, although it remains available to be pulled downwardly at the ring-spinning machine.

6 Claims, 2 Drawing Sheets

METHOD OF AND APPARATUS FOR WINDING ROVING BOBBINS

FIELD OF THE INVENTION

Our present invention relates to a method of and an apparatus for winding roving bobbins and, more particularly, to the terminal stages of such a winding operation in which the oncoming roving slubbing is separated from the bobbin to enable a doffing of the bobbin.

The invention deals especially with a method and apparatus for depositing a roving slubbing and separating the roving slubbing after it has been laid down on the bobbin body using a roving frame with a driven drafting frame, driven flyers, a driven bobbin rail and driven bobbins, whereby following the winding of the bobbin body, a spiral descending winding, followed by a winding around the lower winding cone, and at least one overwinding on the tube below the lower winding cone is formed.

BACKGROUND OF THE INVENTION

In the automatization of spinning operations and especially in the automatic formation of yarn whereby roving bobbins from a roving frame are subjected to spinning on a ring-spinning frame, it has been increasingly important to reduce the cost. This mandates specification of certain requirements. One of these requirements is that the thread or yarn from the roving bobbin be automatically extracted, easily, while the roving bobbin as a whole remains stable and can be handled without loss of capacity to automatically extract the roving or strand. This requirement has primarily been satisfied in the past by depositing at least a partial turn of stubbing, at the conclusion of the winding of the roving body, on a lower winding cone and thereafter separating or breaking the roving slubbing to allow doffing of the roving bobbin. The result is that the roving bobbins can be easily transferred and handled in the mounting of the bobbins in the creel of a ring-spinning machine. That means that an extraction of the slubbing from the bobbin downwardly directly should be possible to allow the bobbin to be tied into the yarn formed in the spinning machine.

There are systems in which the separation of the roving slubbing is a requirement for the automatic removal of full roving bobbins (EP 0 409 755 B1). The process of this patent is satisfactory for long fibers in which, upon stopping of the flyers, the respective pressing fingers can lie against the lower conical regions of the respective bobbins to give rise to a partial opening of the roving slubbing. In this case, a partial rotation of the bobbin is effected while the flyer is held stationary and the roving slubbing is broken. The bobbin can then be removed from the bobbin rail.

Another prior arrangement for this purpose has been described in EP 0 698 678 A1. In the process and apparatus described here, the roving slubbing is separated. This process is so carried out that after the end of the spinning of the roving bobbin, the latter is raised until the pressing finger is guided against the lower cone portion of the bobbin. The roving bobbin is then rotated together with the flyer and the feed from the drafting frame is effected so as to generate a high tension in the winding formed on the roving bobbin.

The roving bobbin is then dropped relative to the flyer to separate oncoming slubbing from the roving bobbin in the region between the winding region and the flyer. Reference may be had also to the process and apparatus described in JP Hei-7-11524-A in which, after the termination of the winding of the body of roving, the pressing finger and the bobbin rail are displaced into an opposite position in which a separation of the roving slubbing is not effected. Then in this position the flyer and the roving bobbin are again set into operation whereby a separation of the roving slubbing automatically is effected.

OBJECTS OF THE INVENTION

It is the principal object of the present invention to provide a method of and an apparatus for the winding of a roving bobbin or, more particularly, for the last portion of the slubbing winding and separating the slubbing so that the roving frame used can carry out the separation in the most economical manner and without significant structural expense and in such manner that the free end of the roving slubbing can be extracted from the full bobbin easily and reliably.

Another object of the invention is to provide an improved method of winding a roving bobbin whereby drawbacks of earlier systems are avoided.

It is also an object of the invention to improve upon the terminal phases of roving bobbin winding so that the roving body can be handled easily and without damage, but the ease with which the roving can be withdrawn from the body of the bobbin is not impeded.

Still another object of this invention is to improve the ability to automatically transport and transfer roving bobbins and to automatically extract the strand therefrom in, for example, a ring-spinning machine.

SUMMARY OF THE INVENTION

The key to the present invention is to provide a rising spiral winding around the lower winding cone and to which a short spiral winding is affixed on the lower portion of the bobbin body. The roving bobbin and the bobbin rail are then so moved in conjunction with a reduction of the bobbin rotation speed so that roving separation occurs in a rising region of the bobbin.

More specifically, a method of winding a roving bobbin can comprise:

(a) winding a roving coming from a driven drafting frame in a bobbin body on a roving bobbin tube with a flyer frame having a driven flyer on a driven flyer rail and on driven bobbin rail with driven bobbins, the bobbin body having a central cylindrical portion, an upper winding cone at an upper end of the central cylindrical portion and a lower winding cone at a lower end of the central cylindrical portion;

(b) terminating the winding of the bobbin body at a first location on the central cylindrical portion;

(c) winding at least a partial turn of the roving in a descending slubbing path along the central cylindrical portion from the first location to a second location at a junction between the lower winding cone and the central cylindrical portion;

(d) then winding the slubbing in a descending path along the lower winding cone in at least a partial turn to a third location at a bottom of the lower winding cone;

(e) then winding the slubbing in an overwinding for at least a partial turn onto the tube below the lower winding cone to a fourth location at the bottom of the lower winding cone;

(f) then winding the slubbing in a rising spiral for at least a partial turn along the lower winding cone to a fifth location at the junction between the lower winding cone and the central cylindrical portion;

(g) then winding the slubbing onto a lower portion of the cylindrical body in a short spiral stretch to a sixth location; and (h) then moving the bobbin and the bobbin rail to draw the slubbing upwardly along the central cylindrical portion, thereby pulling out the short spiral stretch and separating the slubbing in a rising stretch thereof along the central cylindrical body.

The bobbin rail can be moved downwardly into a bobbin-doffing position after the slubbing has been separated.

In another feature of the invention the supply of roving to the bobbins is cut off during the movement of the bobbin and the bobbin rail.

A method of the invention is associated with a number of advantages:

Firstly, the end of the yarn winding lies on the lower winding cone which reduces the possibility that the roving will fall off the bobbin in subsequent transport.

By relatively simple looping of the roving slubbing on the roving bobbin, it is possible to ensure that the roving bobbin will avoid the unraveling of the bobbin upon a rise of the pressing finger during the upward movement.

The point at which the roving slubbing is broken or separated from the body of the bobbin is located along the central cylindrical position thereof.

A shorter stretch of the strand dangles from the pressing finger following the last stages of winding.

As a general matter, the method and apparatus of the invention requires a roving frame and stretching frame with a drive specific to the various movable parts, or a system having a common drive or all of the parts and controls to perform the requisite steps.

In one aspect of the invention, therefore, the apparatus comprises:

a drafting frame having a drafting frame drive for feeding roving;

a flyer frame receiving roving from the drafting frame and having a flyer rail with respective flyers having a flyer drive and a bobbin rail with a bobbin-rail drive having bobbins with a bobbin drive, the flyers having pressing fingers applying respective rovings to respective bobbins; and a controller connected to the drives for effecting winding of each of the bobbins by the steps of:

(a) winding a roving coming from the drafting frame in a bobbin body on a roving bobbin tube in the flyer frame, the bobbin body having a central cylindrical portion, an upper winding cone at an upper end of the central cylindrical portion and a lower winding cone at a lower end of the central cylindrical portion;

(b) terminating the winding of the bobbin body at a first location on the central cylindrical portion;

(c) winding at least a partial turn of the roving in a descending slubbing path along the central cylindrical portion from the first location to a second location at a junction between the lower winding cone and the central cylindrical portion;

(d) then winding the slubbing in a descending path along the lower winding cone in at least a partial turn to a third location at a bottom of the lower winding cone;

(e) then winding the slubbing in an overwinding for at least a partial turn onto the tube below the lower winding cone to a fourth location mat the bottom of the lower winding cone;

(f) then winding the slubbing in a rising spiral for at least a partial turn along the lower winding cone to a fifth location at the junction between the lower winding cone and the central cylindrical portion;

(g) then winding the slubbing onto a lower portion of the cylindrical body in a short spiral stretch to a sixth location; and (h) then moving the bobbin and the bobbin rail to draw the slubbing upwardly along the central cylindrical portion, thereby pulling out the short spiral stretch and separating the slubbing in a rising stretch thereof along the central cylindrical body.

In another aspect of the invention, after the slubbing is separated, the bobbin rail is moved downwardly into a bobbin-doffing position.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
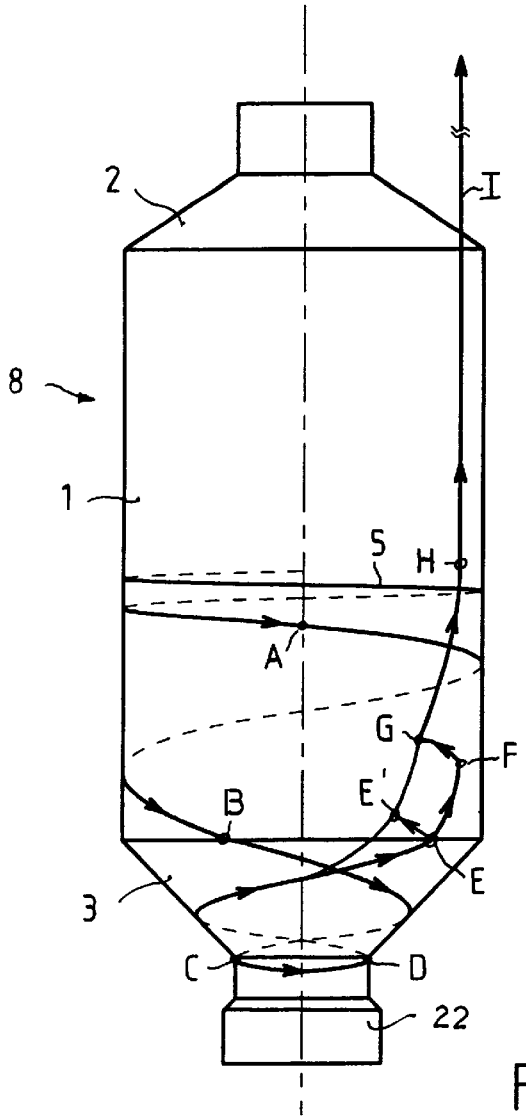
FIG. 1 is a diagrammatic elevational view schematically showing the path of the yarn in the terminal stage of the winding operation.

FIG. 1 shows in a highly diagrammatic form a winding sleeve, core or tube 22 carrying a fully wound roving bobbin 8 having a cylindrical central portion or body of the bobbin, an upper winding cone 2 at the upper end of the cylindrical central portion 1 and a lower winding cone 3 at the bottom of the cylindrical central portion 1. The method of depositing the roving yarn on the roving bobbin 8 at the conclusion of the winding operation and prior to doffing and the separation of the breaking of the roving slubbing 5 formed toward the end of the bobbin winding operation is carried out as follows:

Toward the end of winding at a first location A, a spiral descending winding over at least part of a turn (at least a partial turn) extends downwardly to a second location B from which that winding continues in at least a partial turn to a third location C. The spiral descending winding A-B around the central cylindrical portion 1 is thus followed by the winding B-C along the lower cylindrical cone. The spiral winding B-C is followed by a winding C-D around the core tube 22 at the bottom of the lower winding cone 3. The location D has been referred to as the fourth location elsewhere herein. The roving slubbing 5 is then located in the lower region of the lower winding cone 3.

The winding then rises in a spiral D-E to a fifth location E (crossing over the spiral winding B-C on the lower winding cone) where that winding D-E is formed into a short spiral E-F running to the sixth location F.

The roving slubbing 5, in the absence of further feed of the roving from the drafting frame and by movement of the roving bobbin 8 and the bobbin rail 10 forms the stretch F-G-H, in part by a reduction in the bobbin rotation in the intermediate region F-G, whereupon the roving 5 is pulled from point E to point E'.

This is followed by the roving slubbing separation, i.e. the separation of the slubbing 5 in a rising region G-H of the cylindrical body. In the region of the stroke H-I the bobbin rail with the bobbins 8 is lowered from the position shown in FIGS. 3 and 4 into a doffing position.

The movement of the roving bobbin and bobbin rail in the stretch F-G-H is carried out advantageously without further supply of the roving slubbing.

Figure 2:
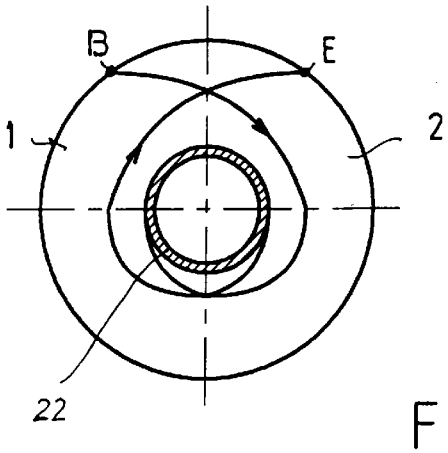
FIG. 2 is a bottom view taken in section through a portion of the winding tube and showing the roving slubbing thereon.

FIG. 2 shows the view from below, the critical points being labelled.

Figure 3:
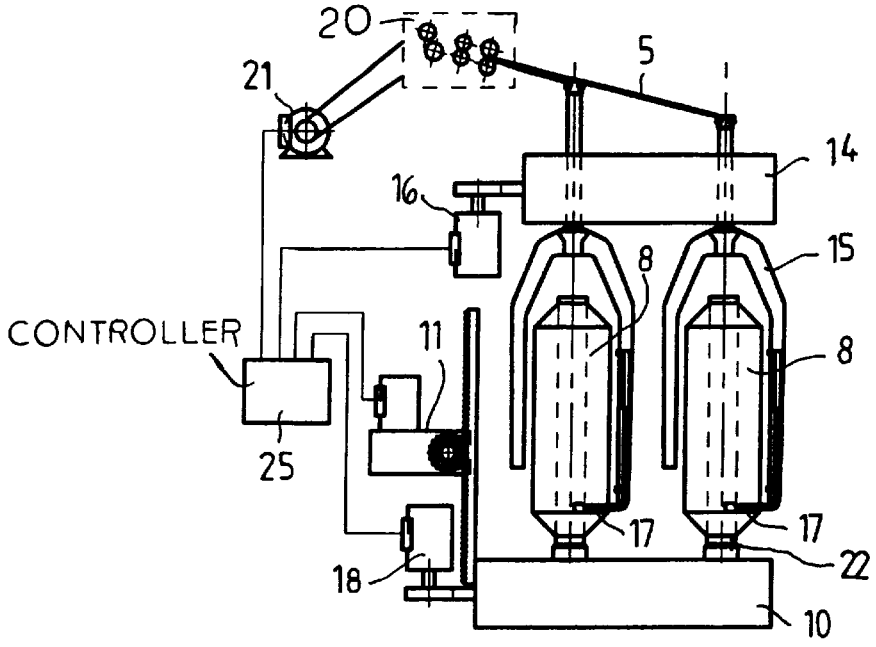
FIG. 3 is a diagrammatic side elevational view of a roving frame with two rows of flyers and having separate drives for the various parts.

FIG. 3 is a schematic side view of a roving frame or the essential elements of a roving frame, namely, the drafting frame 20 with its own drive 21, the flyer rail 14 with flyers 15 operated by the drive 16, a bobbin rail 10 with a drive for raising and lowering this bobbin rail as represented at 11 and with a drive 18 for the bobbins 8. In this case, the roving frame has separate drives for the essential elements. According to the invention, a controller 25 is provided and is coupled to the drives 11, 16, 18, 21 to effect the following steps:

(a) winding a roving coming from a driven drafting frame in a bobbin body on a roving bobbin tube with a flyer frame having a driven flyer on a driven flyer rail and on driven bobbin rail with driven bobbins, the bobbin body having a central cylindrical portion, an upper winding cone at an upper end of the central cylindrical portion and a lower winding cone at a lower end of the central cylindrical portion;

(b) terminating the winding of the bobbin body at a first location on the central cylindrical portion;

(c) winding at least a partial turn of the roving in a descending slubbing path along the central cylindrical portion from the first location to a second location at a junction between the lower winding cone and the central cylindrical portion;

(d) then winding the slubbing in a descending path along the lower winding cone in at least a partial turn to a third location at a bottom of the lower winding cone;

(e) then winding the slubbing in an overwinding for at least a partial turn onto the tube below the lower winding cone to a fourth location at the bottom of the lower winding cone;

(f) then winding the slubbing in a rising spiral for at least a partial turn along the lower winding cone to a fifth location at the junction between the lower winding cone and the central cylindrical portion;

(g) then winding the slubbing onto a lower portion of the cylindrical body in a short spiral stretch to a sixth location; and (h) then moving the bobbin and the bobbin rail to draw the slubbing upwardly along the central cylindrical portion, thereby pulling out the short spiral stretch and separating the slubbing in a rising stretch thereof along the central cylindrical body.

While no other modification besides the addition of the control unit 25 is necessary, it is possible to provide a single drive for the whole system.

Figure 4:
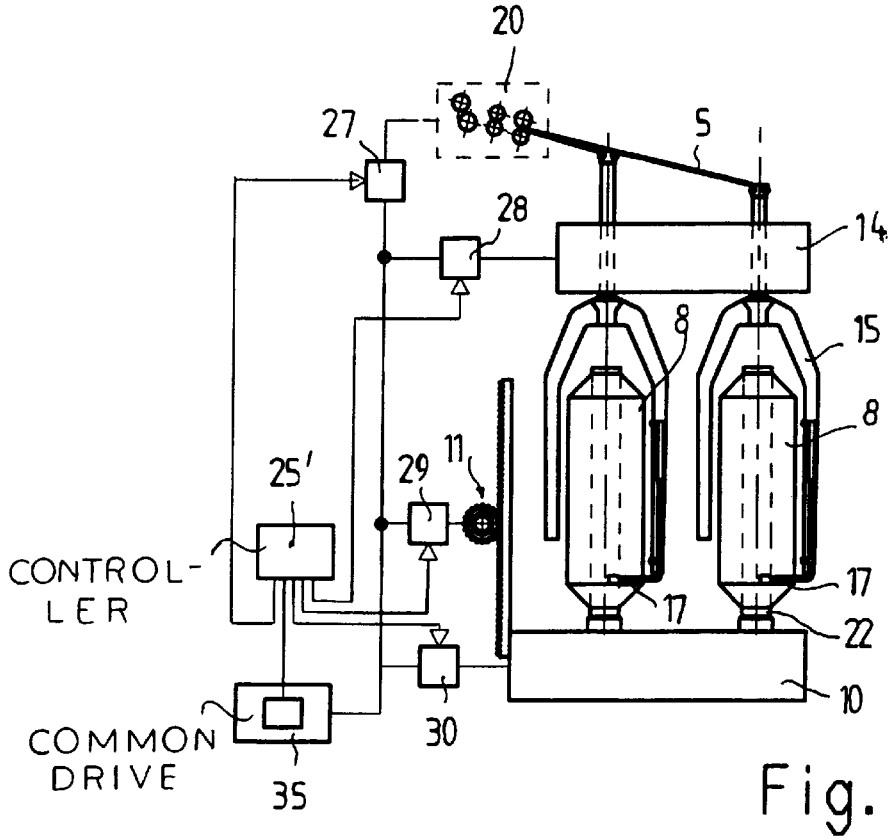
FIG. 4 is a view similar to FIG. 3 of a roving frame showing the two rows of flyers and utilizing a common drive.

FIG. 4 shows a roving frame in side elevation having a single drive 35, also known as a common drive for the drafting frame via the subordinate driver 27. A coupling 28, like the. coupling 27 between the common drive 35 and the drafting frame 20 may be a controlled clutch and serves to drive the flyers 15 which are mounted for rotation in the flyer rail 14. The coupling (clutch) 29 is disposed between the drive 11 for raising and lowering the bobbin rail 10 and can be operated by the controller 25' shown in FIG. 4.

A further coupling or clutch 30 is interposed between the drive unit 35 and the bobbin drives in the bobbin rail 10. The controller 25' is effectively a servomechanism for the clutches 27,28, 29 and 30 and so controls these clutches that in spite of the fact that the elements are individually driven, the units can be controlled to effect steps as stated. The invention ensures that the end of the roving slubbing will lie on the lower winding cone, thereby preventing that slubbing from falling out during transport. However it is possible to automatically draw the slubbing from the bobbin at the ring-spinning frame.

What is claimed is:

1. A method of winding a roving bobbin comprising the steps of:

(a) winding a roving coming from a driven drafting frame to form a bobbin body on a roving bobbin tube with a flyer frame having a driven flyer on a driven flyer rail and on driven bobbin rail with driven bobbins, said bobbin body having a central cylindrical portion, an upper winding cone at an upper end of the central cylindrical portion and a lower winding cone at a lower end of said central cylindrical portion;

(b) terminating the winding of said bobbin body at a first location on said central cylindrical portion;

(c) winding at least a partial turn of the roving in a descending slubbing path along said central cylindrical portion from said first location to a second location at a junction between said lower winding cone and said central cylindrical portion;

(d) then winding said slubbing in a descending spiral along said lower winding cone in at least a partial turn to a third location at a bottom of said lower winding cone;

(e) then winding said slubbing for at least a partial turn onto said tube below said lower winding cone to a fourth location at the bottom of said lower winding cone;

(f) then winding said slubbing in a rising spiral for at least a partial turn along said lower winding cone to a fifth location at said junction between said lower winding cone and said central cylindrical portion and crossing over said descending spiral on said lower winding cone;

(g) then winding said slubbing onto a lower portion of said cylindrical body in a short spiral stretch to a sixth location; and (h) then moving said bobbin and the bobbin rail to draw said slubbing upwardly along said central cylindrical portion, thereby pulling out said short spiral stretch and separating said slubbing in a rising stretch thereof along said central cylindrical body below said upper winding cone.

2. The method defined in claim 1 comprising cutting off the supply of roving to the bobbin during the movement of said bobbin and said bobbin rail.

3. The method defined in claim 2 comprising moving the bobbin rail downwardly, after the slubbing is separated, into a bobbin-doffing position.

4. The method defined in claim 1 comprising moving the bobbin rail downwardly, after the slubbing is separated, into a bobbin-doffing position.

5. An apparatus for winding roving bobbins, comprising:

a drafting frame for feeding roving;

a flyer frame receiving roving from said drafting frame and having a flyer rail with respective flyers and a bobbin rail having bobbins, the flyers having pressing fingers applying respective rovings to respective bobbins;

a common drive for said drafting frame, said flyers, the bobbin rail and the bobbins; and a controller connected to said common drive for effecting winding of each of said bobbins by the steps of:

(a) winding a roving coming from said drafting frame to form a bobbin body on a roving bobbin tube in said flyer frame, said bobbin body having a central cylindrical portion, an upper winding cone at an upper end of the central cylindrical portion and a lower winding cone at a lower end of said central cylindrical portion;

(b) terminating the winding of said bobbin body at a first location on said central cylindrical portion;

(c) winding at least a partial turn of the roving in a descending slubbing path along said central cylindrical portion from said first location to a second location at a junction between said lower winding cone and said central cylindrical portion;

(d) then winding said slubbing in a descending spiral along said lower winding cone in at least a partial turn to a third location at a bottom of said lower winding cone;

(e) then winding said slubbing for at least a partial turn onto said tube below said lower winding cone to a fourth location at the bottom of said lower winding cone;

(f) then winding said slubbing in a rising spiral for at least a partial turn along said lower winding cone and crossing over said descending spiral on said lower winding cone to a fifth location at said junction between said lower winding cone and said central cylindrical portion;

(g) then winding said slubbing onto a lower portion of said cylindrical body in a short spiral stretch to a sixth location; and (h) then moving said bobbin and the bobbin rail to draw said slubbing upwardly along said central cylindrical portion, thereby pulling out said short spiral stretch and separating said slubbing in a rising stretch thereof along said central cylindrical body below said upper winding cone.

6. An apparatus for winding roving bobbins, comprising:

a drafting frame having a drafting frame drive for feeding roving;

a flyer frame receiving roving from said drafting frame and having a flyer rail with respective flyers having a flyer drive and a bobbin rail with a bobbin rail drive having bobbins with a bobbin drive, the flyers having pressing fingers applying respective rovings to respective bobbins; and a controller connected to said drives for effecting winding of each of said bobbins by the steps of:

(a) winding a roving coming from said drafting frame to form a bobbin body on a roving bobbin tube in said flyer frame, said bobbin body having a central cylindrical portion, an upper winding cone at an upper end of the central cylindrical portion and a lower winding cone at a lower end of said central cylindrical portion;

(b) terminating the winding of said bobbin body at a first location on said central cylindrical portion;

(c) winding at least a partial turn of the roving in a descending slubbing path along said central cylindrical portion from said first location to a second location at a junction between said lower winding cone and said central cylindrical portion;

(d) then winding said slubbing in a descending spiral along said lower winding cone in at least a partial turn to a third location at a bottom of said lower winding cone;

(e) then winding said stubbing for at least a partial turn onto said tube below said lower winding cone to a fourth location at the bottom of said lower winding cone;

(f) then winding said slubbing in a rising spiral for at least a partial turn along said lower winding cone and crossing over said descending spiral on said lower winding cone to a fifth location at said junction between said lower winding cone and said central cylindrical portion;

(g) then winding said slubbing onto a lower portion of said cylindrical body in a short spiral stretch to a sixth location; and (h) then moving said bobbin and the bobbin rail to draw said slubbing upwardly along said central cylindrical portion, thereby pulling out said short spiral stretch and separating said slubbing in a rising stretch thereof along said central cylindrical body below said upper winding cone.

* * * * *